United States Patent [19]

Hitch

[11] Patent Number: 4,927,359

[45] Date of Patent: May 22, 1990

[54] FLUID DISTRIBUTION APPARATUS

[75] Inventor: Thomas T. Hitch, Lawrenceville, N.J.

[73] Assignee: General Electric Company, Schenectady, N.Y.

[21] Appl. No.: 331,717

[22] Filed: Apr. 3, 1989

[51] Int. Cl.[5] ..... F27B 5/16; F27B 5/10; F27B 5/04

[52] U.S. Cl. ..... 432/206; 432/136; 432/152; 432/144; 432/198; 432/200; 137/561 A; 137/561 R; 118/715

[58] Field of Search ..... 118/725, 715; 432/136, 432/144, 145, 148, 152, 171, 198, 200, 206, 205; 137/561 A, 561 R

[56] References Cited

U.S. PATENT DOCUMENTS

| | | | |
|---|---|---|---|
| 2,938,473 | 5/1960 | Mahoney et al. | 432/148 X |
| 3,138,372 | 1/1962 | Beck | 432/200 X |
| 4,108,106 | 8/1978 | Dozier | 118/715 |
| 4,144,045 | 3/1979 | Starr | 432/205 X |
| 4,148,275 | 4/1979 | Benden et al. | 118/715 |
| 4,263,872 | 4/1981 | Ban . | |
| 4,377,080 | 3/1983 | Fox | 137/561 A |
| 4,401,689 | 8/1983 | Ban . | |
| 4,499,853 | 2/1985 | Miller | 118/715 X |
| 4,809,643 | 3/1989 | Plesinger et al. | 118/715 |
| 4,825,809 | 5/1989 | Mieno | 118/715 X |
| 4,838,201 | 6/1989 | Fraas et al. | 118/725 X |

*Primary Examiner*—Henry A. Bennet

*Attorney, Agent, or Firm*—Henry I. Steckler; James C. Davis, Jr.; Paul R. Webb, II

[57] ABSTRACT

A two-stage gas distribution nozzle for a muffle furnace includes an inner pipe with spaced apertures for feeding gas at spaced intervals to an outer pipe enclosing the inner pipe. The outer pipe includes spaced apertures facing in a direction such that the jets of gas from the inner pipe impinge on a wall of the outer pipe opposite the outer pipe apertures. The gas in the outer pipe is at lower pressure than the gas in the inner pipe and is more uniformly distributed along the length of the outer pipe to provide more uniform flow to the ambient atmosphere in the muffle.

13 Claims, 2 Drawing Sheets

FLUID DISTRIBUTION APPARATUS

The present invention relates to a fluid distribution system for uniformly distributing a fluid in a given region and particularly for distributing a gas in a muffle furnace.

By way of example a muffle furnace capable of maintaining a typical gas atmosphere is disclosed in U.S. Pat. No. 4,767,324 which is incorporated by reference herein. This is one example of a system in which the present fluid distribution system may be utilized. These furnaces include a muffle envelope which is usually a tubular arrangement which extends for the length of the furnace. At the entrance, or mouth of the furnace, there is an entrance curtain comprising upper and lower perforated plates for gas distribution. Further along into the furnace there may be structures known as spargers. Spargers are structures which distribute gases to different portions of the furnace. The spargers may be staged also to create different atmospheres in different portions of the burnout region of the furnace. Spargers comprise a main gas distribution tube which extends the length of a given stage. They have a gas inlet pipe coupled at one end to receive gas at the furnace mouth and a port at the opposite end inside the muffle coupled to a tubular gas distribution plenum. The gas distribution plenum comprises an enclosed rectangular in section tubular structure having openings along its length. The openings differ in aperture size to provide uniform distribution of the gas supply from the gas tube port. The plenum distributes gas to the furnace region directly beneath it. This type of distribution system suffers from the drawback in that as the gas inlet pressure is changed, the different size apertures cause different pressure drops along the length of the plenum such that uneven gas distribution results. It is often the case that a system can deliver uniform gas distribution at only one inlet pressure. However, furnaces of this complexity typically need a wide latitude of adjustment.

A second type of gas distribution system in a muffle furnace includes a transverse pipe having a plurality of uniformly spaced openings of like size for distributing jets of gas against a moving conveyor belt beneath the openings of the pipe for creating a curtain of gas. This curtain of gas is used to provide a separation of different stages of the furnace to prevent the migration of gases from one section to another section of the furnace. Normally the transition gas barrier distribution systems, as these are known, include a pipe with evenly spaced equal size apertures along the length thereof which introduce a liner array of jet streams of the barrier gas. Such a system is disclosed in U.S. Pat. No. 4,767,324. However, these jet streams also suffer from the drawback in that they may have different flow rates due to the pressure gradient that exists in the pipe between the gas inlet and the apertures furthest from the gas inlet.

An example of a sparger and gas barrier distribution system are disclosed in more detail in the aforementioned U.S. Patent. A drawback of these gas distribution systems is that it is desired that a laminar flow of gas be present to ensure optimum processing of the materials being processed by the furnace. Such materials include, for example, thick film integrated circuits which are passed through the furnace on an endless conveyor belt. The muffle furnace is required to evaporate residual solvents and react and remove residual organic material in the material being processed. Because of the sensitivity of the integrated circuits being processed to contaminates, it is important that such contaminates be completely removed. Therefore it is important that the atmospheres, which at times may be reactant or neutral, such as oxygen or nitrogen, respectively, be as pure as possible and uniformly distributed over the material being processed. Normally, exhaust ports are included at spaced intervals along the muffle length for exhausting the contaminated atmosphere out of the muffle so that the material being processed is continually flooded with fresh gases. Some of the gases are applied against the material being processed and the conveyor belt to wash out contaminating gases that may be introduced by the belt from the exterior area atmosphere into the muffle. Other of the gases may be directed such as to provide a barrier curtain. Still other distribution systems employed in the muffle may be used solely for the purpose of providing uniform distribution of a particular gas such as nitrogen or fresh air or a reactant gas to provide as uniform a processing of the material as possible.

The present invention recognizes a need for providing a more uniformly distributed gas in a muffle furnace to enhance the operation of the furnace. The operation is enhanced by more uniformly washing unwanted gases from the materials passing through the furnace, more uniformly distributing the gases comprising the atmosphere of the furnace in which the materials are being processed and establishing a more efficient gas barrier curtain.

A fluid distribution apparatus according to the present invention comprises a first plenum adapted to receive a pressurized fluid and having a plurality of spaced first orifices for distributing the received fluid in the plenum to a region exterior to the plenum. The fluid in the plenum is at a first pressure and tends to flow through the orifices in jets. A second plenum has a plurality of spaced second orifices. The second plenum is secured in fluid communication with the first plenum via the first orifices. The first and second orifices are dimensioned so that the fluid in the second plenum is at a second pressure lower than the first pressure. Means direct the jets against a surface in the second plenum to disperse the gas streams. The orifices and means for directing are so aligned as to provide a substantially negligible pressure gradient of the fluid in the second plenum adjacent to the second orifices whereas the second orifices provide substantially uniform fluid distribution to the ambient atmosphere lying outside the second plenum.

BRIEF DESCRIPTION OF THE DRAWINGS

In FIGS. 1 and 2 only so much of a belt muffle furnace 10 is shown as is necessary for an understanding of the present invention. The furnace 10 includes an elongated tubular muffle envelope 12. The envelope 12 extends for the atmosphere containment portion of the furnace and may be over 20 feet in length. The envelope 12 has a mouth (not shown) which receives the material to be processed, for example, hybrid integrated circuits, on an endless conveyor belt 14. The conveyor belt 14 may be a wire mesh or other material inert to the high temperatures and the gases in the different stages of the furnace. Belt 14 moves in direction 16 for transporting material through the furnace.

Figure 1:
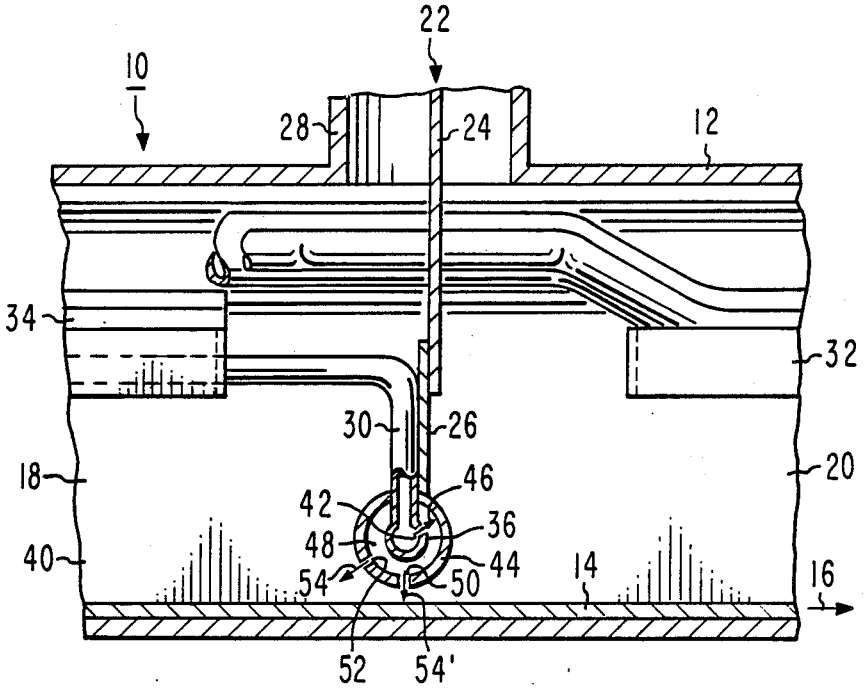
FIG. 1 is an end sectional elevation view of a fluid distribution system in accordance with one embodiment of the present invention for distributing a gas in a transition section of a muffle furnace.

The furnace 10 includes successive stages including a first stage 18 and a second stage 20. These two stages are just several of a larger number of stages which are present in the furnace. Each stage may be for example, five feet in length. The stage 18 may have a nitrogen atmosphere and may be at a first temperature for example, 350° C. The second stage 20 may have a nitrogen-oxygen atmosphere and may be at a second temperature, for example, 550° C. Other stages may have different atmospheres and different temperatures including a subsequent final cooling stage. A stage (not shown) includes a firing region which is subsequent to stages 18 and 20 and which is also referred to as a burnout region. The firing region sinters metal constituents and fuses the material to form a thick film structure; e.g., a multilayer thick film copper structure and compatible dielectric. Stages 18 and 20 are separated by a transition section 22. The transition section 22 is secured permanently within the envelope 12 and is generally not removable from the muffle as compared to the removable transition section shown in U.S. Pat. No. 4,767,324. Not shown are heating elements which surround the muffle sections for heating the different stages. Transition section 22 includes two transition section plates 24 and 26 which divide the furnace and exhaust stack 28. Not shown is an exhaust fan for exhausting the atmosphere from the interior of the muffle 12 via the exhaust stack 28. Plate 24 is secured to plate 26. Plate 24 is welded to the stack 28 and muffle envelope 12. Plate 26 is releasably secured to the muffle envelope 12 to allow for thermal exposition and contraction. Plates 24 and 26 are transverse the length dimension of the muffle.

A gas pipe 30 is secured to plate 26, for example, by screws, weld joints or other means. Pipe 30 is L-shaped and extends through the muffle mouth for connection to a source of gas (not shown), e.g., nitrogen.

Spargers 32 and 34 are described in more detail in the aforementioned patent and form no part of the present invention. In the aforementioned patent the sparger 34 and pipe corresponding to pipe 39 are removable. In the present embodiment, the sparger 34 may be removable but the pipe 30 need not be. However it is to be understood that the pipe 30 and its connected gas distribution system to be described may also be made removable as disclosed in that patent. The present structure is disclosed for purposes of simplicity of illustration.

Figure 2:
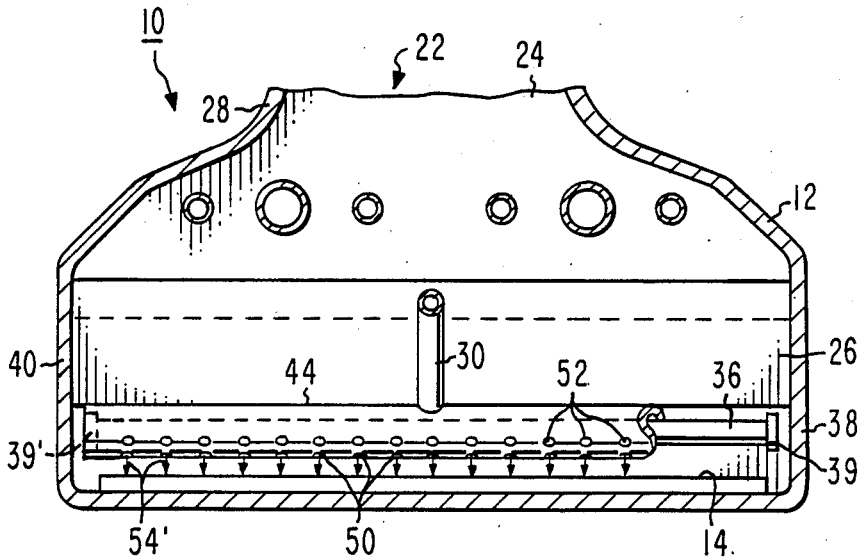
FIG. 2 is a side elevation view of the transition section of the embodiment of FIG. 1.

The pipe 30, FIG. 1, is connected to a transverse pipe 36 which may be, for example, a quarter to a half inch outside diameter Inconel material. The inlet pipe 30 is in gas communication with the interior of pipe 36. The pipe 36 extends transversely across the muffle envelope 12 terminating at ends which are spaced slightly from the muffle walls 38 and 40, FIG. 2. The pipe 36 has a plurality of equally spaced apertures 42 of like diameter along the length of the pipe. Assuming the gas supplied to pipes 30 and 36 is nitrogen, the gas pipes 30 and 36 may be at a pressure of one to two atmospheric pressures. By way of example, the apertures in pipe 36 may have diameters that lie in a range of 0.040 to 0.050 inches and may be spaced 0.250 inch center-to-center. These dimensions are given by way of example and may differ for different implementations.

Pipe 36 is located centrally within a larger pipe 44. Pipe 36 is secured to pipe 44 via pipe 30 at the central region. The pipe 44 also extends transversely spaced from wall 38 to wall 40 of the envelope 12. Pipe 30 may be welded to pipes 36 and 44 at the central region of the pipes.

A sheet metal annular disc 39 is welded to the end of pipe 36 to seal that end of the pipe 36 interior chamber. The disc has a diameter smaller than the internal diameter of pipe 44 and is disposed in the interior of pipe 44 adjacent to the pipe 44 end. The disc 39 supports the pipe 36 at that end axially inside of pipe 44 and is free to slide inside of pipe 44 in response to the extreme temperature excursions of the furnace. Disc 39 closely seats inside pipe 44 to also substantially seal that end of pipe 44. A pair of small holes (not shown) are in disc 39, one hole for permitting gas in pipe 36 to be purged directly into the muffle furnace volume formed by envelope 12 and the other hole for permitting gas in pipe 44 to be also purged directly into the muffle furnace volume. A second disc 39' identical to disc 39 is secured to the other end of pipe 36 and functions identically as that of disc 39. Pipe 44 may be secured also along its length to plate 26, as by welding. In this way, the pipe 36 ends float inside of pipe 44 but are substantially sealed from the remainder of the furnace notwithstanding the presence of the two purge holes at each end. The only significant gas communication of the plenum formed by the interior of pipe 36 with the plenum formed by pipe 44 is the apertures 42 in pipe 36. The relatively higher pressure of the gas in pipe 30 fed to pipe 36 causes the gas in the plenum of pipe 36 to exit the apertures 42 as jet streams 46.

In accordance with the present invention, it is recognized that the jet streams 46 are at relatively high velocities and tend to vary in velocity somewhat along the length of pipe 36 as the distance of the apertures 42 from the inlet pipe 30 increases due to the pressure drop within pipe 36. The pressure gradient in pipe 36 normally tends to be relatively large and the velocity of the streams 46 exiting from the different apertures 46 of the pipe 36 tends to differ significantly from those apertures close to inlet pipe 30 as compared to those close to the ends of pipe 36 adjacent walls 38 and 40. This pressure drop and change in velocities is undesirable as it creates a nonuniform gas distribution of the gases into the chamber formed by the muffle envelope 12. The pressure in pipe 36, therefore is kept sufficiently high to minimize its pressure gradient within pipe 36. This tends to provide more uniform stream velocities through the different apertures 42.

It is desirable in this kind of a furnace that the curtain of gas which separates the two adjacent stages be as uniform as possible along the entire length of the transition section 22 to provide optimum separation of the stages Further, depending on where the gas distribution system is located within a muffle, the streams of gases may be used to wash over the belt 14. This washes contaminating air that may be introduced into the belt pockets as the belt passes into the furnace within the envelope 12. It is important that ambient air be removed from the belt to avoid contaminating the processed materials as discussed above in the introductory portion. The gas "knife" produced by the curtain should be continuous for this purpose also. However, the resultant high and low pressures caused by the jet streams 46 and resulting relatively low gas flow between the jet streams forms "holes" in the gas curtain formed by the jet streams and may allow some contamination to pass from one stage to the next in the "holes" in the curtain or result in nonuniform gas distribution within a stage. This condition tends to be alleviated by the addition of pipe 44.

Pipe 44 forms a plenum 48 between pipe 36 and the walls of pipe 44. The pipe 44 includes two sets of apertures 50 and 52. The apertures 50 are directly beneath the pipe 44 and closest to the belt 16. The apertures 52 are spaced somewhat toward the muffle mouth in the direction opposite direction 16 for causing gas to flow in the direction of arrows 54 against belt 16 for a washing the belt 16 and parts on the belt with the nitrogen gas. The gas flows from apertures 50 to provide a relatively continuous barrier curtain of gas streams of substantially uniform pressure to separate stage 18 from stage 20. It should be understood that the apertures 52 normally are not required for a transition section in a burnout region. The apertures 52 if used in a transition section are used to remove contaminating gases from the surface of materials so those gases can be exhausted from that stage without passing to the next stage. The apertures 52 are shown in the transition section 22 for purpose of illustration rather than limitation.

The pipe 44 preferably may be a one inch diameter Inconel material in which the apertures 50 are also 0.040 to 0.050 inch in diameter. The apertures 50 and 52 are equally spaced on 0.125 inch centers along the length of pipe 44. The gas within the plenum 48 may be, for example, one quarter to one half of an atmosphere above ambient atmosphere pressure outside pipe 44.

The streams 46 of the gas are directed against an interior side of the pipe 44 in a direction away from the location of the apertures 50 and 52. Streams 46 impinge upon the interior sidewall of pipe 44 and are dispersed from the sidewall causing the gas to flow more uniformly in the region of the apertures 50 and 52. As a result of this dispersion and the uniformity of velocity of the streams 46, the gas pressure adjacent the apertures 50 and 52 tends to be uniform along the length of the pipe 44. This uniform pressure distribution within the plenum 48 of pipe 44 tends to result in more uniform laminar flow of the gas through all of the apertures 50 and 52 forming a continuous curtain of gas as compared to the higher velocity jet streams 46. This laminar flow of gas, for example in directions 54 and 54', tends to provide more uniform gas distribution over the belt 14. Further, where the gas distribution is adjacent to the mouth of the furnace, the gas flow in directions 54 tends to more uniformly wash ambient gases from the belt 14 and from the materials being processed. Of course, the spacing of apertures 50 and apertures 52 will effect the uniformity of the gas curtain formed. Therefore, the closer the spacing of the apertures, the more continuous the curtain.

Figure 3:
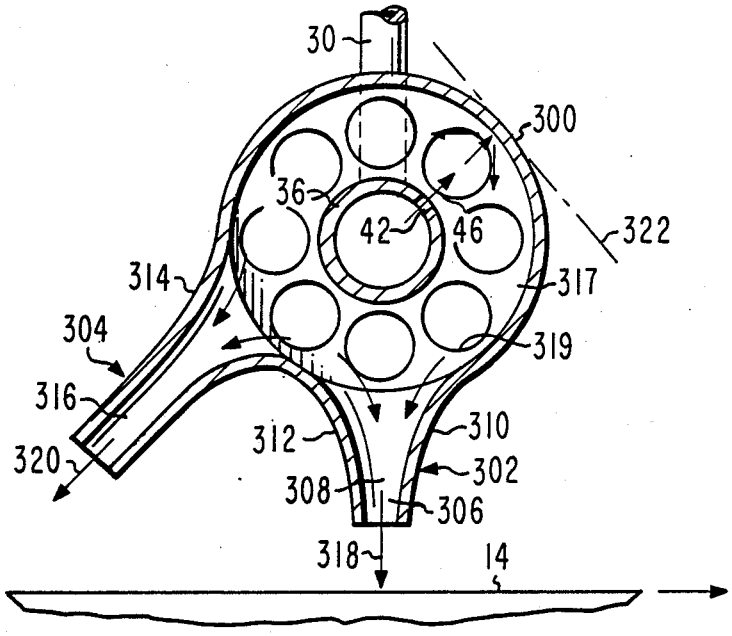
FIG. 3 is a sectional view of a second embodiment of a gas distribution transition section for use in a muffle furnace.

FIG. 3 is a second embodiment of the present invention directed toward providing a more continuous gas curtain. Reference numerals that are identical to numerals employed in FIGS. 1 and 2 refer to identical parts. Pipe 36 is located within pipe 300. Pipe 300 is a larger diameter pipe having a diameter similar to the diameter of pipe 44, FIG. 2. In place of apertures 50 and 52 of pipe 44, FIGS. 1 and 2, however, the pipe 300 includes first and second nozzles 302 and 304. Nozzles 302 and 304 each include a linear array of rectangular abutting slits approximately one half inch in length in a direction perpendicular to the drawing plane and about 0.050 inches in width parallel to the drawing plane generally from left to right in the Figure. The nozzle 302 includes a slit 306 having a septum 308. Septum 308 is preferably of sheet metal having a thickness of about 0.050 inch, for example. Slit 306 has a sidewall 310 which may be formed of sheet metal extending into the plane of the drawing for the length of pipe 300 and formed with a concave curve as shown. The septa 308 of the slits are spaced every one half inch into the plane of the drawing to separate each of the slits 306. Adjacent septum 308 form two walls of a slit 306. A second concave wall of the nozzle 302 is formed by wall 312. Wall 312 is formed of sheet metal which forms a sidewall both of nozzle 302 and nozzle 304. The septa 308 are also welded to wall 312.

Nozzle 304 comprises a sheet material wall 314 which is somewhat less concave than wall 310 and welded to pipe 300. A plurality of spaced septa 316 are welded to walls 314 and 312 to form a linear array of slits in the nozzles. Septa 316 are parallel to septa 308, of generally the same thickness, and are spaced similarly as septa 308.

A plurality of periodically spaced circular baffle plates 317 are disposed along the length of pipe 36 and secured thereto as by welding. The plates 317 have cutouts 319 to provide gas communication along the length of pipe 300. Plates 317 serve to support pipe 36 within pipe 300. The plates are free to slide axially in and out of the drawing relative to pipe 300, the plates abutting but not otherwise secured to the interior wall of pipe 300. The plates 317, for example, may be integral with the septa 308 and 316 every several inches along the length of pipes 300 and 36.

Nozzle 302 produces a gas flow in direction 318 and nozzle 304 produces a gas flow in direction 320. The flow of gases through the nozzles 302 and 304 tends to be more continuous along the length of the nozzles 302 and 304 than that of the embodiment of FIG. 2. This provides a more homogeneous continuous uniform linear curtain of gas as compared to the relatively abrupt pressure changes occurring between discrete spaced streams produced by more widely spaced apertures. The jet streams 46 from apertures 42 flow against the wall of pipe 300 which wall lies generally in plane 322 normal to jets 46. The jet streams 46 impinge on pipe 300 and disperse as shown to provide a substantially uniform pressure distribution in pipe 300. The septa 308 and 316 are made of relatively thin sheet material so as to have negligible effect on the pressure differential between the gas streams flowing through openings formed by adjacent septa.

Figure 4:
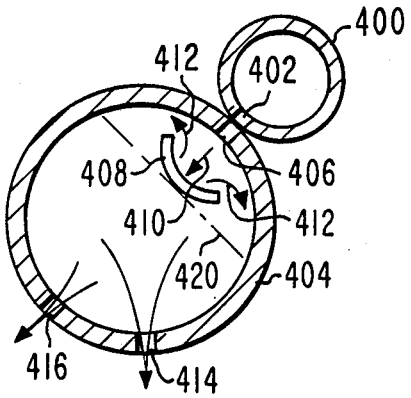
FIG. 4 is a third embodiment of a gas distribution system in accordance with the present invention.

In FIG. 4, pipe 400 receives gas from an inlet pipe (not shown) similar to pipe 30 and forms a first plenum at a first pressure. Pipe 400 has a linear array of apertures 402 of approximately the same size as the apertures of pipe 36 in the embodiments of FIGS. 1 and 2. Pipe 400 is welded to a larger diameter pipe 404 which serves as the low pressure plenum corresponding to pipe 44 in the embodiment of FIG. 1. Pipe 404 has inlet apertures 406 aligned with and in communication with apertures 402, each pair forming a single aperture. Secured within pipe 404 is a baffle plate 408, preferably arcuate, spaced aligned with the apertures 402 and 406 in a direction preferably perpendicular to the plane of the drawing and extending for the length of the pipe 404. The relative orientation of plate 408 is to enhance the dispersion of the incident gas streams. The plate 408 is spaced from the apertures 406 a distance sufficient to cause dispersion of the jets 410 of gas from pipe 400 through apertures 402 and 406. The jets 410 impinge upon plate 408 and are dispersed in directions 412. Pipe 404 includes two sets of apertures 414 and 416 lying in parallel arrays along the length of pipe 404 in a direction perpendicular to the drawing sheet. This orientation is similar to that of apertures 50 and 52 and nozzles 302 and 304 in the respective embodiments of FIGS. 1 and 3.

In operation, gas is introduced into the pipe 400 from the inlet pipe as discussed above in connection with the embodiments of FIGS. 1 and 3. This gas may be at a pressure of one to two atmospheres. The gas is formed into gas streams jets 410 from the pipe 400 and impinge against the baffle plate 408. The resultant gas dispersion in the directions of arrows 412 caused by the baffle plate 408 causes more uniform distribution of the gas in the plenum formed by pipe 404. The gas pressure adjacent to the apertures 414 and 416 tends to be more uniform with a relatively negligible pressure gradient along the length of pipe 404. This uniform gas distribution adjacent to apertures 414 and 416 results in more uniform flow of gas through the apertures 414 and 416.

The plate 408 is oriented approximately parallel to and lies on plane 420. This plane corresponds somewhat to plane 322, FIG. 3, normal to jets 46 and a corresponding plane (not shown) in the embodiment of FIG. 1. As can be observed from FIGS. 3 and 4, the jets 46 and 410, respectively, are directed in a direction somewhat normal to the planes 322 and 420. The surface of pipe 44, FIG. 1, pipe 300, FIG. 3, and baffle 408, FIG. 4, receiving the jets, are oriented somewhat normal to the respective jets. This normal orientation generally provides uniform dispersion of the impinging gas streams into the plenum formed by the larger pipes. The gas eventually flows throughout the volume formed by the plenum chambers to provide more uniform pressure distribution along the length of the larger pipes. The dispersed gases therefore exhibit a minimized pressure gradient between the different exit apertures of the different nozzles. The resultant flow tends to be laminar through the nozzles and the difference in pressure in the gas flowing through the different apertures is also minimized.

While the system is employed in a transition section it is apparent that this gas distribution system may be employed in nontransition sections mainly for the purpose of gas distribution within the muffle. Also while the pipes 44, 300 and 404 of the different embodiments are illustrated as linear it is apparent that a nonlinear gas distribution systems, for example, circular, may also be used. In this case, a central gas inlet pipe may feed different sections of a circular gas distribution pipe through various feedarms from the central inlet pipe. The important aspect of the present invention is to provide a multiple stage pressure reduction device in which a first plenum has spaced apertures for providing uniform gas or fluid distribution along the length of that plenum to a second plenum. The lower pressure gas distribution along the length of the second plenum provides more uniform gas distribution from the second plenum to the ambient atmosphere. It will be apparent that other shapes than the linear and circular shapes discussed above may be employed with a multiple stage nozzle system in accordance with the present invention. Also, additional stages may be provided such as in a three plenum system to provide even greater uniformity of pressure distribution as may be required by a given implementation. In a three stage system successive plenum stages are coupled similarly as shown in FIGS. 1–4 to redirect the streams from the higher pressure stage in a direction away from the openings in the lower pressure stage. By reducing the spacing between openings to the ambient in the larger external pipe, a more uniform, continuous fluid curtain is provided.

What is claimed is:

1. A fluid distribution apparatus for an atmosphere exhibiting temperature excursions, said apparatus comprising:

a first plenum adapted to receive pressurized fluid and having a plurality of spaced first orifices for distributing the received fluid in said plenum to a region exterior said plenum, the fluid in said plenum being at a first pressure and tending to flow through said orifices in jets;

a second plenum having a plurality of spaced second orifices, said second plenum being secured in fluid communication with said first plenum via said first orifices, the first and second orifices being dimensioned so that the fluid in the second plenum is at a second pressure lower than said first pressure, said plenums tending to expand and contract differently in response to said temperature excursions;

means for directing the jets against a surface in said second plenum to disperse the flow of said jets, said orifices and means for directing being so aligned and the pressure differential in the first and second plenums being sufficiently different so as to provide a substantially negligible pressure gradient of said fluid in said second plenum in a region along and adjacent to said second orifices;

securing means for securing said first plenum to said second plenum and for allowing said secured first and second plenums to move relative to one another in response to said different expansions and contractions of said plenums; and wherein said means for directing includes means for directing jets in a direction approximately towards said second orifices, said apparatus further including baffle means in the second plenum between said first and second orifices for dispersing the fluid in said jets.

2. The apparatus of claim 1 wherein said means for directing include means for securing the first plenum within the second plenum and for directing said jets against an interior wall of the second plenum on a side of the second plenum opposite said second orifices.

3. The apparatus of claim 1 wherein said fluid is a gas.

4. The apparatus of claim 1 wherein the first and second orifices are arranged in first and second linear arrays.

5. The apparatus of claim 4 further including means for orienting the arrays parallel on opposing sides of said second plenum.

6. The apparatus of claim 1 wherein the first orifices are of like dimension and uniform spacing in a given direction and said second orifices are of like dimension and uniform spacing in said given direction.

7. The apparatus of claim 1 wherein the first pressure is in the range of about 1 to 2 atmospheres above ambient pressure and the second pressure is less than 1 atmosphere above ambient pressure.

8. The apparatus of claim 1 wherein the second orifices are rectangular slits and the first orifices are circular.

9. The apparatus of claim 8 wherein the slits extend in a linear array, the slits each having a length much greater than its width, said width dimension extending parallel to the direction of said linear array.

10. The apparatus of claim 1 wherein said second plenum has a plurality of spaced third orifices adjacent to the second orifices.

11. A fluid distribution apparatus for an atmosphere exhibiting temperature excursions, said apparatus comprising:

a first plenum adapted to receive pressurized fluid and having a plurality of spaced first orifices for distributing the received fluid in said plenum to a region exterior said plenum, the fluid in said plenum being at a first pressure and tending to flow through said orifices in jets;

a second plenum having a plurality of spaced second orifices, said second plenum being secured in fluid communication with said first plenum via said first orifices, the first and second orifices being dimensioned so that the fluid in the second plenum is at a second pressure lower than said first pressure, said plenums tending to expand and contract differently in response to said temperature excursions;

means for directing the jets agaist a surface in said second plenum to disperse the flow of said jets, said orifices and means for directing being so aligned and the pressure differential in the first and second plenums being sufficiently different so as to provide a substantially negligible pressure gradient of said fluid in said second plenum in a region along and adjacent to said second orifices;

securing means for securing said first plenum to said second plenum and for allowing said secured first and second plenums to move relative to one another in response to said different expansions and contractions of said plenums; and wherein said securing means includes means for slideably securing one plenum to the other plenum, said slideably securing means including means fixedly secured to one of said plenums and moveable relative to the other of said plenums and arranged to support said other of said plenums and the plenums each have first and second ends, the first plenum being located within the second plenum, said means fixedly secured including baffle means secured at said first and second ends for enclosing each said first and second ends of each said plenums.

12. The apparatus of claim 11 wherein said plenums are circular pipes, said baffle means comprising a different disk located at each end of said pipes.

13. The apparatus of claim 12 including gas feed means for supplying said fluid to said first plenum in a central region thereof, said securing means including means for securing said feed means to both said plenums at said central region.

* * * * *